8/21/84 XR 4,466,668

United States Patent [19]

Ricketts

[11] Patent Number: 4,466,668

[45] Date of Patent: Aug. 21, 1984

[54] METHOD OF FORMING AN IN SITU OIL SHALE RETORT IN FORMATION WITH JOINTS

[75] Inventor: Thomas E. Ricketts, Grand Junction, Colo.

[73] Assignee: Occidental Oil Shale, Inc., Grand Junction,, Colo.

[21] Appl. No.: 479,483

[22] Filed: Mar. 28, 1983

[51] Int. Cl.[3] ..... E21B 43/247; E21C 41/10

[52] U.S. Cl. ..... 299/2; 166/251; 166/259; 299/13

[58] Field of Search ..... 299/2, 13; 166/251, 166/259

[56] References Cited

U.S. PATENT DOCUMENTS

| | | | |
|---|---|---|---|
| 3,205,942 | 9/1965 | Sandberg | 166/251 |
| 4,043,596 | 8/1977 | Ridley | 299/2 |
| 4,360,233 | 11/1982 | Ricketts | 299/2 |
| 4,423,906 | 1/1984 | Studebaker | 299/2 |

OTHER PUBLICATIONS

Sellers et al, Rock Mechanics Research on Oil Shale Mining, Presented at AIME Annual Meeting, 1971.

Mining Engineer's Handbook, Peele, Ed., 3rd Ed., vol. 1, pp. 477, 478, 1959 John Wiley & Sons, N.Y.

*Primary Examiner*—George A. Suchfield

*Attorney, Agent, or Firm*—Christie, Parker & Hale

[57] ABSTRACT

A method for forming an in situ oil shale retort in a retort site in a subterranean formation containing oil shale and having at least one set of naturally occurring cleavage planes is provided. The in situ oil shale retort contains a fragmented permeable mass of formation particles formed within top, bottom, and side boundaries of unfragmented formation. A void is excavated in the subterranean formation within the boundaries of the retort site, while a zone of unfragmented formation is left within the retort boundaries adjacent the void. A plurality of rows of horizontally spaced apart explosive charges is formed in the zone of unfragmented formation where each such row is in a line about perpendicular to the strike of the major cleavage plane set in the formation. The rows of explosive charges are detonated in a selected sequence with the charges in each such row detonated about simultaneously for explosively expanding the zone of unfragmented formation toward the void for forming the fragmented permeable mass of formation particles in the retort.

21 Claims, 5 Drawing Figures

METHOD OF FORMING AN IN SITU OIL SHALE RETORT IN FORMATION WITH JOINTS

FIELD OF THE INVENTION

This invention relates to the in situ recovery of shale oil and, more particularly, to techniques for facilitating the formation and improving the operation of an in situ oil shale retort.

BACKGROUND OF THE INVENTION

The presence of large deposits of oil shale in the high plateau, semi-arid region of the western United States has given rise to extensive efforts to develop methods for recovering shale oil from kerogen in the oil shale deposits. It should be noted that the term "oil shale" as used in the industry is, in fact, a misnomer; it is neither shale nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil".

A number of methods have been proposed for processing oil shale which involve either first mining the kerogen-bearing shale and processing the shale on the ground surface or processing the shale in situ. The latter approach is preferably from the standpoint of environmental impact since the treated shale remains in place, reducing the chance of surface contamination and the requirement for disposal of solid wastes.

The recovery of liquid and gaseous products from oil shale deposits has been described in several patents such as U.S. Pat. Nos. 3,661,423; 4,043,597; 4,043,598; and 4,192,554; and in U.S. patent application Ser. No. 070,319 filed Aug. 27, 1979, now abandoned, by Chang Yul Cha and Thomas E. Ricketts, entitled TWO-LEVEL, HORIZONTAL FREE FACE MINING SYSTEM FOR IN SITU OIL SHALE RETORTS. Each of these applications and patents is assigned to Occidental Oil Shale, Inc., assignee of this application, and each is incorporated herein by this reference.

These patents and applications describe in situ recovery of liquid and gaseous hydrocarbon materials from a subterranean formation containing oil shale, wherein such formation is explosively expanded to form a stationary fragmented permeable mass of formation particles containing oil shale within the formation, referred to herein as an in situ oil shale retort, or merely as a retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition called "retorting". Such decomposition in the oil shale produces gaseous and liquid products, including gaseous and liquid hydrocarbons, and a residual carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off-gas is also withdrawn from the bottom of the retort. Such off-gas can include carbon dioxide generated in the combustion zone, gaseous products produced in the retorting zone, carbon dioxide from carbonate decomposition, and any gaseous retort inlet mixture that does not take part in the combustion process.

U.S. Pat. Nos. 4,043,597; 4,043,598; and 4,192,554 disclose methods for explosively expanding formation containing oil shale toward horizontal free faces to form a fragmented mass in an in situ oil shale retort. According to such a method, a plurality of vertically spaced apart voids of similar horizontal cross-section are initially excavated one above another within the retort site. A plurality of vertically spaced apart zones of unfragmented formation are temporarily left between the voids. A plurality of horizontally spaced apart vertical columnar explosive charges, i.e., an array of explosive charges, is placed in each of the unfragmented zones and detonated to explosively expand each unfragmented zone upwardly and/or downwardly towards the void or voids above and/or below it to form a fragmented mass having an average void volume about equal to the void volume of the initial voids. Retorting of the fragmented mass is then carried out to recover shale oil from the oil shale.

U.S. patent application Ser. No. 070,319 discloses a method for explosively expanding formation containing oil shale towards a horizontal free face to form a fragmented mass in an in situ oil shale retort. According to such a method, a void having a horizontal cross-section similar to the horizontal cross-section of the retort being formed is initially excavated. A plurality of vertically spaced apart zones of unfragmented formation are left above the void. Explosive is placed in each of the unfragmented zones and detonated for explosively expanding such zones towards the void to form a fragmented mass in the retort having an average void volume about equal to the void volume of the initial void. The overlying zones can be expanded towards the void in a single round or a plurality of rounds. Retorting of the fragmented mass is then carried out to recover shale oil from the oil shale.

It is desirable to have a generally uniformly distributed void fraction in the fragmented mass so that there is generally uniform permeability. Thus, oxygen-supplying gas and combustion gas can flow reasonably uniformly through the fragmented mass during retorting operations. A fragmented mass having generally uniform permeability avoids bypassing portions of the fragmented mass by retorting gas as can occur if there is gas channelling through the mass due to non-uniform permeability.

Uneven gas flow and gas channeling in a retort due to non-uniform permeability of the fragmented mass can result in reduced yields of gaseous and liquid products from the retort. For example, when gas flow is uneven, portions of the fragmented mass can be bypassed by retorting gas and, thus, not retorted. Uneven gas flow can also cause some regions of a combustion zone to advance more rapidily through the retort than other regions, resulting in a skewed combustion zone. When this happens, shale oil and product gases produced in a lagging region of the retorting zone may be decomposed in a leading region of the combustion zone. Additionally, when the combustion zone is skewed, the leading region of the combustion zone can reach the bottom of the retort before the remaining regions. When any region of a combustion zone reaches the bottom of a retort, off-gas temperatures and/or the oxygen content of the off-gas can increase to above safe levels and it may be necessary to discontinue retorting. In this case, retorting is discontinued while oil shale particles in the fragmented mass downstream from lagging regions of the combustion zone remain unretorted.

It is, therefore, desirable to provide a method for explosively expanding oil shale formation toward a horizontal free face which results in a fragmented mass of formation particles in the retort being formed having a reasonable uniformity of void fraction distribution and permeability.

SUMMARY OF THE INVENTION

This invention relates to a method for forming an in situ oil shale retort containing a fragmented permeable mass of formation particles within top, bottom, and side boundaries of unfragmented formation in a subterranean formation containing oil shale and having at least one set of naturally occurring cleavage planes. At least one void is excavated in the subterranean formation within the retort boundaries, while leaving a zone of unfragmented formation within the retort boundaries having a generally horizontally extending free face adjacent the void. At least one row of horizontally spaced apart explosive charges is formed in the zone of unfragmented formation with such a row being in a line about perpendicular to the strike of the major cleavage plane set. The charges in the row are detonated about simultaneously for explosively expanding the zone of unfragmented formation toward the free face to thereby form the fragmented permeable mass of formation particles in the retort.

DRAWINGS

These and other features, aspects, and advantages of the present invention will be more fully understood when considered with respect to the following detailed description, appended claims, and accompanying drawings wherein:

Figure 3:
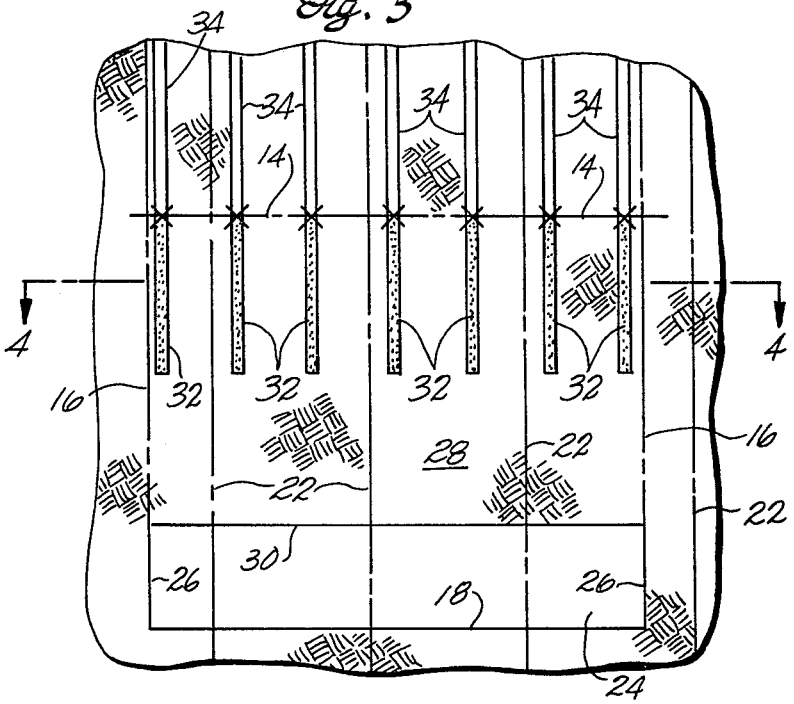
FIG. 3 is a semi-schematic, vertical cross-sectional view of the retort of FIG. 1 at one stage during its formation.
Figure 4:
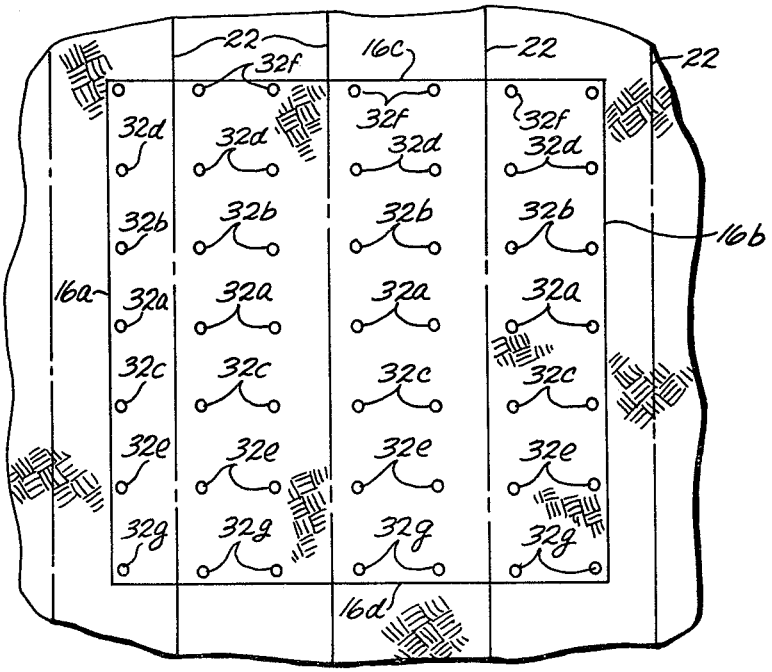
Figure 5:
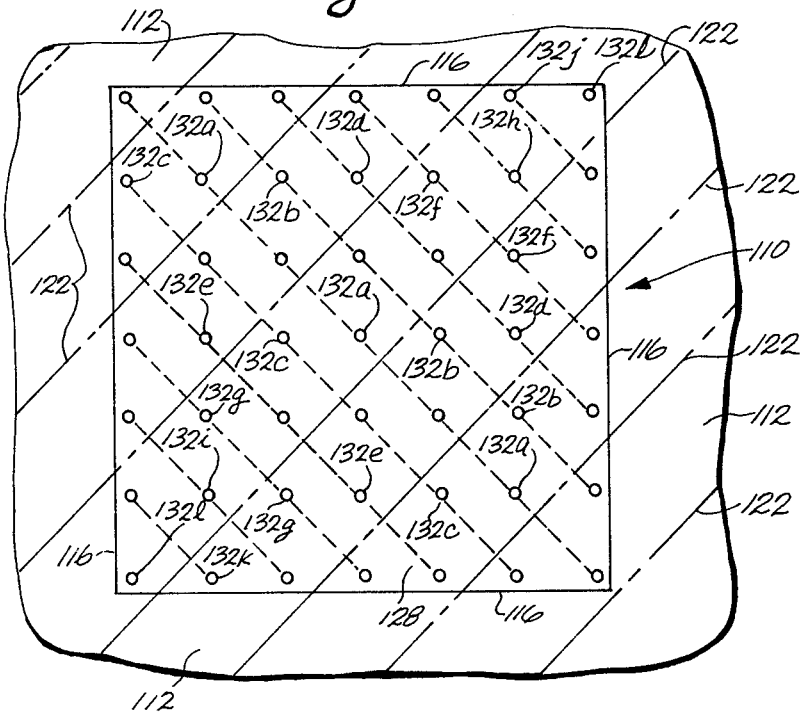

FIG. 4 is a semi-schematic, horizontal, cross-sectional view of the in situ oil shale retort taken on line 4—4 of FIG. 3 showing a preferred pattern of explosive charges; and FIG. 5 is a semi-schematic, horizontal, cross-sectional view of another exemplary embodiment of an in situ oil shale retort at one stage during its formation in accordance with this invention showing another preferred pattern of explosive charges.

DETAILED DESCRIPTION

Figure 1:
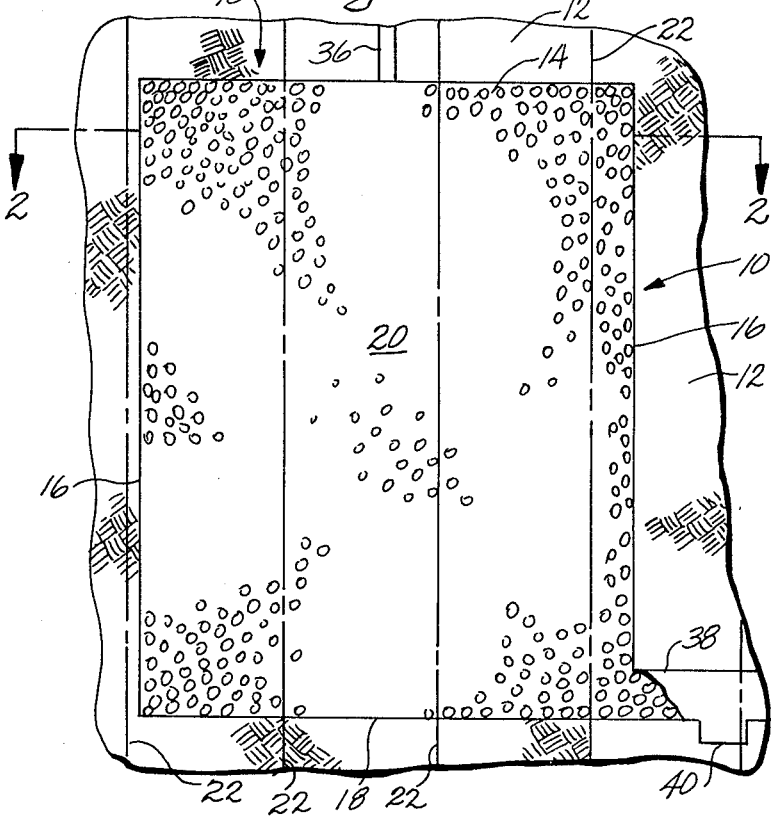
FIG. 1 is a semi-schematic, vertical, cross-sectional view of one exemplary embodiment of an in situ oil shale retort provided in accordance with practice of principles of this invention in a subterranean formation having a set of naturally occuring cleavage planes.
Figure 2:
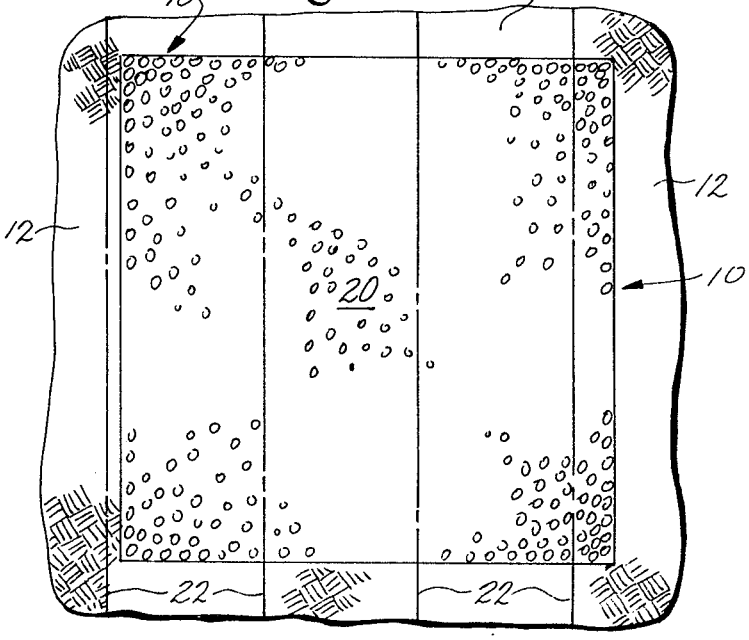
FIG. 2 is a semi-schematic, horizontal, cross-sectional view of the in situ oil shale retort taken on line 2—2 of FIG. 1.

Referring to FIGS. 1 and 2, there are shown semi-schematic vertical and horizontal cross-sectional views of one embodiment of an in situ oil shale retort 10 formed in accordance with practice of principles of this invention in a subterranean formation 12 containing oil shale.

The in situ retort has a top boundary 14, four vertically extending side boundaries 16, and a bottom boundary 18 of unfragmented formation. In the illustrated embodiment, the retort 10 is square in horizontal cross-section, but retorts having rectangular cross-sections other than square, as well as other shapes, are also contemplated. The retort contains a fragmented permeable mass of formation particles 20 containing oil shale formed by explosive expansion of unfragmented oil shale formation toward one or more voids excavated within the retort boundaries. As is described below in greater detail, the pattern of explosive charges in the unfragmented formation and the charge detonation sequence provided in accordance with practice of this invention enhances the uniformity of void fraction distribution and permeability of the fragmented mass.

As described above, subterranean formations containing oil shale are sedimentary in nature. Such formations are made up of a very large number of deposition layers laid down eons ago that became deeply buried in the earth's crust where temperatures and pressures transformed the deposits into hard competent rock and converted organic matter into kerogen. In the oil shale formations in the Piceance Creek Basin of western Colorado, for example, such deposition layers can be readily seen in the rock strata and generally lie near horizontal. Some of the layers are inherently weak and the formation can be readily cleaved parallel to interfaces between such horizontal layers, i.e., parallel to the bedding planes.

A number of subterranean formations containing oil shale, such as the formation 12, in addition to having horizontal bedding planes (not shown), also have cleavage planes which are inclined at angles other than horizontal extending through the formation. A "cleavage plane" is defined in *A Dictionary of Mining, Mineral and Related Terms,* U.S. Bureau of Mines, U.S. Dept. of Interior (1968), as "Any uniform joint, crack, or change in quality of formation along which rock will break easily when dug or blasted".

The cleavage planes of subterranean formations containing oil shale are natural structures which generally develop by pressure and are not necessarily visible in the unfragmented rock formation. They are, in effect, planes of weakness where the oil shale is most likely to break. Commonly, such cleavage planes are referred to as "joints" and thus the terms "cleavage planes" and "joints" are used interchangeably herein.

The joints in a subterranean oil shale formation can be somewhat scattered in size, spacing, and orientation in a given volume of oil shale. The joints or cleavage planes are not, however, completely random. They tend to be in sets of more or less parallel orientation. In a typical oil shale deposit in the Piceance Creek Basin in western Colorado, there are two such sets of cleavage planes extending at approximately right angles to each other.

The orientation of such a set of cleavage planes is defined by their "dip" and "strike". The term "dip" as used herein is the angle at which a bed, stratum, or vane is inclined from the horizonatal. The term "strike" as used herein is the direction or bearing of a horizontal line in the plane of an inclined stratum, joint, fault, cleavage plane, or other structural plane and is perpendicular to the direction of dip.

Although, as mentioned above, cleavage planes are not readily visible structures in unfragmented oil shale formation, their orientation can be determined after excavation of oil shale. For example, a survey is made of flat faces found on the walls of excavated drifts, tunnels, or the like. The dip and strike of a substantial number of such flat faces are determined. A statistical analysis of these surveyed faces indicates the orientation of cleavage planes along which the oil shale broke. Generally, the flat faces lie in two or more cleavage plane or fracture sets, which can be subdivided into a major or principal fracture set and one or more minor or secondary fracture sets. Generally, there are more fractures in the major set of cleavage planes than in the minor set and additionally the fractures of the major set are more well developed than the fractures of the minor set. If there is only one set of cleavage planes in the formation, it is considered to be the "major" set.

It has been found that there is some angular dispersion of cleavage planes within a cleavage plane set. That is, when orientations of fractures of the underground formation are determined, they are not found precisely parallel to each other. The fractures have a deviation in strike which can be a few degrees each side of the mean value of the strike. The term "strike" when used herein with reference to a cleavage plane set is defined as the mean value of the strike of the joints in that set. Some dispersion can also be found in the dip of the cleavage planes, e.g., although the mean value of an exemplary set of cleavage planes can be substantially vertical, i.e., the set of cleavage planes has a dip of between 80° and 90°, the individual cleavage planes may deviate a few degrees from the mean value.

The system of cleavage planes is to be distinguished from slip planes that may also be present in various rock formations. The slip planes occur due to stress arising outside the formation. Within localized regions, such slip planes may be generally parallel to each other, but in regions a few hundred feet away, the slip planes may extend in a completely different direction due to localized forces. Thus, the slip planes in a formation extend in generally random directions, whereas the cleavage plane systems are substantially constant over long distances in a formation containing oil shale.

Additional information regarding cleavage planes in oil shale formation can be found in application Ser. No. 837,521 filed Sept. 29, 1977 by now U.S. Pat. No. 4,423,906, Irving G. Studebaker and titled METHOD OF FORMING AN IN SITU OIL SHALE RETORT. Application No. 837,521 is incorporated herein by this reference.

It has been found that explosive expansion of oil shale formation is affected by cleavage planes in a subterranean formation. For example, when cratering to a horizontal free face, the crater can be "cut off" by one of the joints in a typical cleavage plane set. When such a crater is "cut off", it is flat on the cut off side instead of having a normal symmetrical dish-shaped configuration.

When a plurality of charges are detonated at the same time, as in the case for expanding unfragmented formation for forming the fragmented permeable mass of formation in a retort, cutoff of craters by cleavage planes can inhibit charge ineraction. This, in turn, can result in uneven fragmentation causing the fragmented mass being formed to have a non-uniform void fraction distribution and permeability. As is described below in greater detail, such crater cutoff has occurred when a row of charges was detonated in a formation having a cleavage plane set, where the row was oriented in a line parallel to the strike of the cleavage planes.

The effect of a major set of cleavage planes on the blasting operation in an oil shale formation can be more significant than the effect of the one or more associated minor sets.

Practice of principles of this invention is described below with regard to an exemplary subterranean formation 12 which has two sets of cleavage planes; a major set and a minor set, both of which have a dip of about 90°, and are about orthogonal to each other. Referring again to FIGS. 1 and 2, the orientation of the major set of cleavage planes in the formation 12 relative to the retort 10 is shown schematically by the phantom lines or planes 22 that extend through the formation. (The phantom lines are shown extending through the fragmented mass in the retort for purposes of illustration only.) Although the planes 22 illustrate the orientation of the major set of cleavage planes in the formation, they are not representative of the actual number of such cleavage planes or the spacing between adjacent cleavage planes. For example, a retort several hundred feet tall has been formed in oil shale formation where the average spacing between adjacent cleavage planes in the major cleavage plane set was determined to be about 1.2 feet.

The orientation of the minor set of cleavage planes is not shown because the minor set is not directly involved in practice of this invention.

Referring to FIGS. 3 and 4, techniques provided according to this invention for formiing the retort 10 in the subterranean formation 12 having the major set of cleavage planes 22 can be understood. FIGS. 3 and 4 are semi-schematic vertical and horizontal cross-sections, respectively, of the retort 10 at one stage during its formation.

Although the dip of the exemplary major cleavage plane set 22 is about 90°, practice of principles of this invention is also useful for cleavage plane sets having a dip other than 90°.

A generally horizontally extending box-shaped void 24 is excavated in the formation within the retort boundaries. The horizontal cross-section of the void 24 is the same as the horizontal cross-section of the retort 10. Thus, in this embodiment, the void has a square horizontal cross-section. In other embodiments where, for example, the retort being formed has a rectangular cross-section, the excavated void can similarly have a rectangular horizontal cross-section.

The vertical walls 26 of the void 24 form a portion of the side boundaries 16 of the retort. As is best seen in FIG. 4, in the illustrated embodiment, each of the opposed side boundaries **16*a* and 16*b* is about parallel to the strike of the cleavage plane set 22, while each of the opposed side boundaries 16*c* and 16*d*** is about perpendicular to the strike.

A layer or zone of unfragmented formation 28 is left within the retort boundaries extending vertically between the top boundary 14 and a generally horizontally extending free face 30 above the void. The floor of the void is the bottom boundary 18 of the retort.

To form the fragmented permeable mass of formation particles 20 in the retort, the zone of unfragmented formation is loaded with a plurality of explosive charges and the charges are detonated for expanding the zone of unfragmented formation downwardly toward the void, i.e., toward the free face 30.

For simplicity of illustration, in the exemplary embodiment, unfragmented formation is explosively expanded toward only one void, i.e., the void 24. If desired, however, in practice of principles of this invention, more than one horizontally extending void can be excavated in the subterranean formation and formation can be explosively expanded toward each of the excavated voids.

Additional details of expanding formation toward several voids is described in U.S. Pat. No. 4,192,554 incorporated hereinabove by reference. If desired, plural layers can be explosively expanded downwardly toward a single underlying void.

It is desired that the volume of the void 24 comprise at least about 15 percent up to about 35 percent of the total volume of the retort being formed. Thus, the void 24 is a "limited void" with respect to the volume of formation to be explosively expanded toward that void. That is, the void has less available volume than would be required for free expansion of formation toward the void.

When an earth formation is explosively fragmented and expanded, it increases in bulk due to the void space in interstices between the particles. The maximum expansion of oil shale formation into an unlimited void results in a fragmented mass having an average void fraction of about 40 percent; that is about 40 percent of the total volume occupied by the fragmented mass is void space between the particles. The volume occupied by the fragmented mass is about 67 percent larger than the volume occupied by the original unfragmented formation after such unlimited or free expansion. This is sometimes referred to as a bulking factor of 1.67 .

A "limited void" is one where the void space available for explosive expansion is less than needed for free bulking of the formation expanded toward that void. Thus, if a void has an excavated volume less than about 40 percent of the total of the volume of the void plus the volume occupied by formation explosively expanded, it is necessarily a limited void. It has been found that factors in addition to the total available void can make a void "limited" even though the total available void may appear sufficient for free bulking. Thus, the fragmented mass formed by explosive expansion may not expand and completely fill the available void space and the average void fraction in the fragmented mass may be less than projected from available void space.

An array of a plurality of explosive charges 32 is formed in the zone of unfragmented formation 28. The array of charges 32 comprises rows that are perpendicular to the strike of the major cleavage plane set 22 in the formation.

In the illustrated embodiment, the charges are in a square array, i.e., the spacing distance between adjacent charges is equal in orthogonal directions. If desired, however, the charges can be in a rectangular array or in other configurations so long as they are in rows perpendicular to the strike of the cleavage planes.

Preferably, the explosive charges 32 are generally vertical columnar charges formed in blastholes 34 that are about perpendicular to the free face 30 of the zone of unfragmented formation 28. Thus, each such explosive charge 32 is oriented with its longitudinal axis about perpendicular to the free face 30.

The blastholes 34 are drilled downwardly into the zone of unfragmented formation from either the ground surface or from a void space overlying the retort. Alternatively, if desired, the blastholes can be drilled upwardly from the void 24.

Detonators designated by an "x" are placed into each such blasthole 34 for initiating detonation of the explosive charges and the portion of each blasthole above the explosive charge is stemmed with inert material (not shown) such as sand or gravel or the like.

Although the column length of the explosive charges can be as desired, it is preferable that each explosive charge extend from about the top boundary 14 about one-half the distance to the horizontally extending free face 30. That is, each charge extends through about one-half the height of thickness of the zone of unfragmented formation which is being explosively expanded toward the void. It has been determined that having an explosive charge with a column length about one-half the thickness of the formation being expanded toward a free face generally results in the most efficient use of explosive for cratering.

The blastholes and explosive charges are shown out of proportion in the figures for clarity of illustration, i.e., the blastholes and charges are actually much smaller in diameter relatve to the formation than shown.

In accordance with practice of this invention, the charges 32 are detonated in rows perpendicular to the strike of the set of cleavage planes 22. Preferably, all of the charges in each such individual row are detonated simultaneously with all of the rows detonated in a single round time delay sequence. A "single round time delay sequence" as used herein means detonation of a row of charges with only a short time delay between detonation of an adjacent row. A time delay between detonations in a sequence is short when formation explosively expanded by detonation of one of the rows has either not yet moved or is still in motion at the time of detonation of an adjacent row. The time delays in the single round can be provided by electric or non-electric time delay detonating devices associated with the detonators "x" and ties up in trunk lines as is well known in the art.

Referring to FIG. 4, in one exemplary detonation sequence, all of the charges in the row **32*a* are detonated first, followed by simultaneous detonation of the charges in the rows 32*b* and 32*c* adjacent the row 32*a*. Next, all of the charges in the rows 32*d* and 32*e* adjacent the rows 32*b* and 32*c*, respectively, are detonated simultaneously, followed by detonation of the charges in the remaining rows 32*f* and 32*g* adjacent the retort side boundaries 16*c* and 16*d***.

Although, in the illustrated embodiment, there are seven rows with seven charges in each row, more or fewer rows with more or fewer charges in each row can be provided as desired. Also, although the charges adjacent the side boundaries of the exemplary embodiment are in the same line as the remainder of the charges in each such row, in accordance with practice of this invention the charges adjacent the side boundaries (the outer charges) may be aligned off of the lines of the other charges. As used herein, both for placement and detonation of explosive charges, a "row of explosive charges" means all of the charges in a line between two opposed side boundaries, including the outer charges or, alternatively, all of the charges in such a line with the exception of the outer charges. Thus, the phrase "detonating all of the charges in a row (or individual row) about simultaneously" as used herein may or may not include detonation of the outer charges. Furthermore, the term "simultaneously" as used herein means that all of the charges in the row are detonated at the same instant or that the delay between detonation of one or more of the charges in the row is less than about 1 millisecond per foot of spacing between adjacent charges. Where all of the charges in a row are not detonated in the same instant and some of the charges in the row are detonated on the above described delay of less than 1 millisecond per foot of spacing between adjacent charges, some charges in the next row in the sequence may be detonated before detonation of all of the charges in a preceding row is complete.

Preferably, the time delay between detonations of charges in successive rows is less than about 5 milliseconds per foot of spacing between adjacent rows. More preferably, the time delay between detonation of charges in successive rows is from about 1 to about 2 milliseconds per foot of spacing between charges in adjacent rows.

As is described above, it has been found that when charges are detonated in rows parallel to the strike of a major cleavage plane set in a formation, some of the charges do not properly interact because the craters are cut off by the cleavage planes. Conversely, it was determined that when the charges are detonated in rows perpendicular to a major set of cleavage planes, the craters are not cut off and charge interaction is enhanced. This enhances uniformity of fragmentation and results in a fragmented permeable mass of formation particles with enhanced uniformity of void fraction distribution and permeability. It has also been found that using the above described time delay sequence further enhances charge interaction and uniformity of fragmentation.

Thus, practice of this invention of detonating explosive charges in rows perpendicular to the strike of the major cleavage plane set 22 in the formation 12 enhances the uniform explosive expansion of the zone of unfragmented formation 28 toward the void 24. This results in the fragmented permeable mass of formation particles 20 in the retort 10 having an enhanced uniformity of void fraction distribution and permeability.

Although the retort 10 of the embodiment illustrated in FIGS. 1–4 has side boundaries 16 that are orthogonal to the strike of the cleavage plane set 22, retorts oriented at other angles with respect to the strike of the major set of cleavage planes in a formation can be formed by practice of this invention.

Referring, for example, to FIG. 5, there is shown a semi-schematic horizontal cross-sectional view of a retort 110, similar to the retort 10, at one stage during formation in the subterranean formation 112. In this embodiment, the orientation of the strike of a major cleavage plane set in the formation 112 is illustrated by the phantom planes 122. The strike of the cleavage plane set is on a diagonal to the side boundaries 116 of the retort. Thus, each such side boundary 116 forms about a 45° angle with the strike of the cleavage plane set.

Vertical columnar explosive charges 132, similar to the charges 32, are provided in the zone of unfragmented formation 128 in rows perpendicular to the strike of the cleavage plane set 122.

Preferably, in this embodiment, the row of charges **132*a* is detonated first, next followed by rows 132*b* and 132*c*, and so forth until the charges 132*l*** in the corners are detonated.

Preferably, the same time delay sequence is used for detonating the rows of charges 132 as was used for detonating the rows of charges 32 in the embodiment described and shown in FIGS. 1–4.

Although in both of the above exemplary embodiments the row of explosive charges nearest the horizontal center of the retort is detonated first, other row detonation sequences can be used. Also, although corner holes are provided in both embodiments, such corner holes can be deleted, if desired.

In practice of this invention, after the zone of unfragmented formation 28 is expanded for forming the fragmented permeable mass of oil shale particles 20 in the in situ retort 10 as illustrated in FIG. 1, the final preparation steps for producing liquid and gaseous products from the retort are carried out. These steps include drilling at least one gas feed inlet passage 36 downwardly to the top boundary 14 of unfragmented formation so that oxygen-supplying gas can be introduced into the fragmented permeable mass during retorting operations. Alternatively, at least a portion of the blastholes 34 can be used for introduction of the oxygen-supplying gas. A substantially horizontal product withdrawal drift 38 extends away from the lower portion of the fragmented mass at a lower production level in the retort. The product withdrawal drift is used for removal of liquid and gaseous products of retorting.

If desired, liquid and gaseous products can be withdrawn through one or more raises, which can extend upwardly from a lateral drift under the retort into the bottom portion of the fragmented mass, or oxygen-supplying gas can be introduced through a horizontal drift adjacent the top boundary of the retort.

During retorting operations, a combustion zone is established in the fragmented mass of formation particles and the combustion zone is advanced downwardly through such a fragmented mass by introduction of oxygen-supplying gas into the retort. Combustion gas produced in the combustion zone passes through the fragmented mass to establish a retorting zone on the advancing side of the combustion zone when kerogen in the oil shale is retorted to produce liquid and gaseous products of retorting. Liquid products and an off-gas containing gaseous products pass to the bottom of the fragmented mass and are withdrawn from the product withdrawal drift. A pump (not shown) is used to withdraw liquid products from a sump 40 in the product withdrawal drift to above ground. Off-gas is withdrawn by a blower (not shown) and passed to above ground.

The above description of a method for recovering shale oil from a subterranean formation containing oil shale, including the description of the placement and detonation sequence of explosive charges in the zone of unfragmented formation that is explosively expanded to form the fragmented mass in an in situ retort, is for illustrative purposes. Because of variations which will be apparent to those skilled in the art, the present invention is not intended to be limited to the particular embodiments described above. The scope of the invention is defined in the following claims.

What is claimed is:

1. A method for forming an in situ oil shale retort in a subterranean formation containing oil shale and having a major set of naturally occurring cleavage planes, the in situ retort containing a fragmented permeable mass of formation particles containing oil shale within top, bottom, and side boundaries of unfragmented formation, the method comprising the steps of:

excavating at least one void in the subterranean formation within the retort boundaries while leaving a zone of unfragmented formation within the retort boundaries having a generally horizontally extending free face adjacent the void;

forming at least one row of horizontally spaced apart explosive charges in the zone of unfragmented formation, such a row of charges being in a line about perpendicular to the strike of the major cleavage plane set; and detonating all of the charges in the row about simultaneously for explosively expanding the zone of unfragmented formation toward the free face to thereby form the fragmented permeable mass of formation particles in the retort.

2. The method according to claim 1 wherein each such explosive charge is an elongated columnar charge oriented with its longitudinal axis about perpendicular to the generally horizontally extending free face.

3. The method according to claim 1 wherein the mean value of the dip of the major cleavage plane set is between about 80° and 90°.

4. The method according to claim 1 wherein the void is generally square in horizontal cross-section and its four side walls are generally vertical, the first pair of opposed side walls being about parallel to the strike of the major cleavage plane set and the second pair of opposed side walls being about perpendicular to the strike of the major cleavage plane set.

5. The method according to claim 1 wherein the row of explosive charges extends all the way across the retort between two opposed side boundaries.

6. A method for forming an in situ oil shale retort in a subterranean formation containing oil shale and having a major set of naturally occurring cleavage planes, the in situ oil shale retort containing a fragmented permeable mass of formation particles containing oil shale within top, bottom, and side boundaries of unfragmented formation, the method comprising the steps of:

excavating a void in the subterranean formation within the retort boundaries while leaving a zone of unfragmented formation within the retort boundaries having a generally horizontally extending free face adjacent the void;

forming a plurality of rows of horizontally spaced apart explosive charges in the zone of unfragmented formation, each such row being in a line about perpendicular to the strike of the major cleavage plane set; and detonating the rows of explosive charges in a selected sequence where the explosive charges in each such row are detonated about simultaneously for explosively expanding the zone of unfragmented formation toward the free face for forming the fragmented permeable mass of formation particles in the retort.

7. The method according to claim 6 wherein the mean value of the dip of the major cleavage plane set is between about 80° and about 90°.

8. The method according to claim 6 wherein the retort is generally rectangular in horizontal cross-section and the four retort side boundaries are generally vertical, the first pair of opposed side boundaries being about parallel to the strike of the major cleavage plane set and the second pair of opposed side boundaries being about perpendicular to the strike of the major cleavage plane set.

9. The method according to claim 6 wherein the retort is generally rectangular in horizontal cross-section and the four retort side boundaries are generally vertical with each such side boundary forming about a 45° angle with the strike of the major cleavage plane set.

10. The method according to claim 6 wherein all of the rows of explosive charges in such a zone of unfragmented formation are detonated in a single round time delay sequence.

11. The method according to claim 10 wherein the time delay between detonation of adjacent rows of explosive charges is less than about five milliseconds per foot of spacing between such adjacent rows.

12. The method according to claim 10 wherein the time delay between detonation of adjacent rows of explosive charges is between about 1 and 2 milliseconds per foot of spacing between such adjacent rows.

13. The method according to claim 6 wherein the row of explosive charges nearest the center of the zone of unfragmented formation is detonated first, followed by detonation of a row adjacent the center row.

14. The method according to claim 6 wherein the row of explosive charges nearest the center of the zone of unfragmented formation is detonated first, followed by sequential detonation of rows moving outwardly from the center row toward the retort side boundaries.

15. The method according to claim 6 wherein each such explosive charge is an elongated columnar charge oriented with its longitudinal axis about perpendicular to the generally horizontally extending free face.

16. A subterranean formation containing oil shale in an intermediate stage of preparation of an in situ oil shale retort containing a fragmented permeable mass of formation particles within top, bottom, and generally vertically extending side boundaries of unfragmented formation, and having a major set of naturally occurring cleavage planes comprising:

(a) at least one void in the subterranean formation within the retort boundaries;

(b) a zone of unfragmented formation within the retort boundaries having a generally horizontally extending free face adjacent the void;

(c) a plurality of rows of horizontally spaced apart explosive charges in the zone of unfragmented formation, each such row being in a line about perpendicular to the strike of the major cleavage plane set; and (d) means for detonating the rows of explosive charges in a selected sequence where the explosive charges in each such row are detonated about simultaneously for explosively expanding the zone of unfragmented formation toward the free face for forming the fragmented permeable mass of formation particles in the retort.

17. The in situ oil shale retort according to claim 16 wherein the retort is generally rectangular in horizontal cross-section and the four retort side boundaries are generally vertical, the first pair of opposed side boundaries being about parallel to the strike of the major cleavage plane set and the second pair of opposed side boundaries being about perpendicular to the strike of the major cleavage plane set.

18. The in situ oil shale retort according to claim 16 wherein the retort is generally rectangular in horizontal cross-section and the four retort side boundaries are generally vertical with each such side boundary forming about a 45° angle with the strike of the major cleavage plane set.

19. The in situ oil shale retort according to claim 16 comprising means for detonating the plurality of rows of explosive charges in a single round time delay sequence.

20. The method according to claim 19 wherein the detonating means provides for detonation of adjacent rows of explosive charges with a time delay between detonations being less than about 5 milliseconds per foot of spacing between such adjacent rows.

21. The method according to claim 19 wherein the detonating means provides for detonation of adjacent rows of explosive charges with a time delay between detonations being from about 1 millisecond to about 2 milliseconds per foot of spacing between such adjacent rows.

* * * * *